US009212416B2

(12) United States Patent
Williams et al.

(10) Patent No.: US 9,212,416 B2
(45) Date of Patent: Dec. 15, 2015

(54) LOW TEMPERATURE CARBURIZATION UNDER SOFT VACUUM

(75) Inventors: Peter C. Williams, Cleveland Heights, OH (US); Sunniva R. Collins, Cleveland Heights, OH (US); Steven V. Marx, University Heights, OH (US)

(73) Assignee: Swagelok Company, Solon, OH (US)

( * ) Notice: Subject to any disclaimer, the term of this patent is extended or adjusted under 35 U.S.C. 154(b) by 530 days.

(21) Appl. No.: 12/850,925

(22) Filed: Aug. 5, 2010

(65) Prior Publication Data

US 2011/0030849 A1 Feb. 10, 2011

Related U.S. Application Data

(60) Provisional application No. 61/232,148, filed on Aug. 7, 2009.

(51) Int. Cl.
*C23C 8/22* (2006.01)
*C23C 8/20* (2006.01)

(52) U.S. Cl.
CPC .... *C23C 8/20* (2013.01); *C23C 8/22* (2013.01)

(58) Field of Classification Search
CPC ..... C23C 8/22; C23C 8/06; C23C 8/20
USPC ..... 148/206, 218, 235, 237
See application file for complete search history.

(56) References Cited

U.S. PATENT DOCUMENTS

| | | | |
|---|---|---|---|
| 3,796,615 | A | 3/1974 | Westeren et al. |
| RE29,881 | E | 1/1979 | Westeren et al. |
| 4,160,680 | A | 7/1979 | Novy et al. |
| 4,166,610 | A | 9/1979 | Yamazaki et al. |
| 4,168,186 | A | 9/1979 | Limque et al. |
| 4,191,598 | A | 3/1980 | Conybear et al. |
| 4,386,973 | A | 6/1983 | Kawka et al. |
| 4,455,177 | A | 6/1984 | Filippov et al. |
| 4,710,238 | A | 12/1987 | Dawes et al. |
| 4,773,947 | A | 9/1988 | Shibata et al. |
| 4,807,853 | A | 2/1989 | Murakami et al. |
| 4,836,864 | A | 6/1989 | Murakami et al. |
| 5,205,873 | A | 4/1993 | Faure et al. |
| 5,252,145 | A | 10/1993 | Tahara et al. |
| 5,344,502 | A | 9/1994 | Mack et al. |
| 5,376,188 | A | 12/1994 | Tahara et al. |
| 5,556,483 | A | 9/1996 | Tahara et al. |
| 5,593,510 | A | 1/1997 | Tahara et al. |
| 5,702,540 | A | 12/1997 | Kubota |
| 5,792,282 | A | 8/1998 | Tahara et al. |
| 5,988,165 | A | 11/1999 | Richey, II et al. |
| 6,093,303 | A | 7/2000 | Williams et al. |
| 6,101,719 | A | 8/2000 | Kiuchi et al. |
| 6,165,597 | A | 12/2000 | Williams et al. |
| 6,187,111 | B1 | 2/2001 | Waka et al. |
| 6,258,179 | B1 | 7/2001 | Takayama et al. |
| 6,309,474 | B1 | 10/2001 | Yagasaki |
| 6,309,475 | B1 | 10/2001 | Takayama et al. |
| 6,547,888 | B1 | 4/2003 | Williams et al. |
| 6,776,854 | B2 | 8/2004 | Bardeimeier et al. |
| 6,814,573 | B2 | 11/2004 | Hiramoto |
| 6,846,366 | B2 | 1/2005 | Kawata et al. |
| 6,923,180 | B2 | 8/2005 | Richey, II et al. |
| 6,991,687 | B2 | 1/2006 | Poor et al. |
| 7,024,916 | B2 | 4/2006 | Juryozawa et al. |
| 7,029,625 | B2 | 4/2006 | Shimosato et al. |
| 7,033,446 | B2 | 4/2006 | Poor et al. |
| 7,108,756 | B2 | 9/2006 | Lippmann et al. |
| 7,112,248 | B2 | 9/2006 | Yamaguchi |
| 7,118,634 | B2 | 10/2006 | Goldsteinas et al. |
| 7,122,086 | B2 | 10/2006 | Tanaka et al. |
| 7,186,304 | B2 | 3/2007 | Chin et al. |
| 7,208,052 | B2 | 4/2007 | Hammond et al. |
| 7,276,204 | B2 | 10/2007 | Ebihara et al. |
| 7,357,843 | B2 | 4/2008 | Yamaguchi et al. |
| 7,513,958 | B2 | 4/2009 | Kula et al. |
| 7,524,382 | B2 * | 4/2009 | Fink et al. ..... 148/206 |
| 7,550,049 | B2 | 6/2009 | Kula et al. |
| 7,575,643 | B2 | 8/2009 | Ebihara et al. |
| 7,722,801 | B2 | 5/2010 | Sato |
| 7,794,551 | B1 | 9/2010 | Imbrogno et al. |
| 7,811,390 | B2 | 10/2010 | Ishii et al. |
| 7,967,920 | B2 | 6/2011 | Kula et al. |
| 7,998,282 | B2 | 8/2011 | Taniguchi et al. |
| 2002/0166607 | A1 | 11/2002 | Altena et al. |

(Continued)

FOREIGN PATENT DOCUMENTS

| | | |
|---|---|---|
| BG | 51115 | 2/1993 |
| CH | 641840 | 3/1984 |

(Continued)

OTHER PUBLICATIONS

Felder, Richard M., and Ronald W. Rousseau. Elementry Principles of Chemical Processes,. John Wiley & Sons, pp. 196-197, 2000.*
English Abstract and English Machine Translation of Ogawa et al. (JP 2002-194526). (Jul. 10, 2002).*
El-Rahman et al, "Effect of N2 to C2H2 rato on r.f. plasma surface treatment of austentic stainless steel", Surface and Coatings Technology, 183, (2004), 268-274.
Michal, et al., "Surface Hardening of Austenitic Steels by Low Temperature Colossal Supersaturation", Materials Science & Technology MS&T Conference Proceedings 2004 Journal, pp. 347-353.
Stickels, C.A., "Gas Carburizing", ASM Handbook. vol. 4, pp. 312-324, 1991.
International Search Report and Written Opinion from PCT/US10/44510 dated Sep. 23, 2010.
Office action from Chinese Application No. 801080035086.1 dated Dec. 10, 2013, 15 pgs.
International Search Report and Written Opinion from PCT/US13/20196 dated Mar. 19, 2013.
Office action from Chinese Application No. 801080035086.1 dated Oct. 10, 2014, 40 pgs.

(Continued)

*Primary Examiner* — Jessee Roe
(74) *Attorney, Agent, or Firm* — Calfee, Halter & Griswold LLP

(57) ABSTRACT

Low temperature carburization of stainless steel using acetylene as the carburizing specie is carried out under soft vacuum conditions in the presence of hydrogen or other companion gas. As a result, formation of soot and the undesirable thermal oxide film that normally occurs during low temperature carburization is eliminated virtually completely.

32 Claims, No Drawings

(56) References Cited

U.S. PATENT DOCUMENTS

| | | | |
|---|---|---|---|
| 2003/0020214 | A1 | 1/2003 | Poor et al. |
| 2005/0016831 | A1 | 1/2005 | Paganessi et al. |
| 2005/0247375 | A1 | 11/2005 | Suzuki et al. |
| 2006/0090817 | A1 | 5/2006 | Somers et al. |
| 2006/0102253 | A1 | 5/2006 | Berglund |
| 2006/0108719 | A1 | 5/2006 | Jurmann et al. |
| 2006/0124203 | A1 | 6/2006 | Ishida et al. |
| 2006/0130935 | A1 | 6/2006 | Hattori et al. |
| 2006/0137766 | A1 | 6/2006 | Kozawa et al. |
| 2007/0044866 | A1 | 3/2007 | Morita et al. |
| 2007/0062612 | A1 | 3/2007 | Katsumata |
| 2007/0068601 | A1 | 3/2007 | Jones et al. |
| 2007/0102068 | A1 | 5/2007 | Taniguchi et al. |
| 2007/0204934 | A1 | 9/2007 | Hoshino et al. |
| 2007/0246126 | A1 | 10/2007 | Hattori et al. |
| 2008/0006346 | A1 | 1/2008 | Sato |
| 2008/0073001 | A1 | 3/2008 | Katsumata |
| 2008/0073002 | A1 | 3/2008 | Abukawa et al. |
| 2008/0076001 | A1 | 3/2008 | Uchiyama et al. |
| 2008/0149225 | A1 | 6/2008 | Connery et al. |
| 2008/0156399 | A1 | 7/2008 | Machida et al. |
| 2008/0216922 | A1 | 9/2008 | Katsumata |
| 2008/0247901 | A1 | 10/2008 | Morita et al. |
| 2009/0084470 | A1 | 4/2009 | Kato et al. |
| 2009/0178733 | A1 | 7/2009 | Somers et al. |
| 2009/0197112 | A1 | 8/2009 | Fink et al. |
| 2009/0266449 | A1 | 10/2009 | Ohbayashi et al. |
| 2009/0308497 | A1 | 12/2009 | Jo et al. |
| 2009/0320962 | A1 | 12/2009 | Nakai et al. |
| 2010/0037991 | A1 | 2/2010 | Collins et al. |
| 2010/0043582 | A1 | 2/2010 | Tateishi et al. |
| 2010/0084051 | A1 | 4/2010 | Mizuno et al. |
| 2010/0276036 | A1 | 11/2010 | Hazel et al. |
| 2011/0017350 | A1 | 1/2011 | Hammond et al. |
| 2011/0036462 | A1 | 2/2011 | Berlier et al. |
| 2011/0067784 | A1 | 3/2011 | Grafen et al. |
| 2011/0108164 | A1 | 5/2011 | Jain et al. |
| 2011/0129382 | A1 | 6/2011 | Jo et al. |
| 2011/0206473 | A1 | 8/2011 | Thompson et al. |
| 2011/0277887 | A1 | 11/2011 | Foerster et al. |
| 2013/0186520 | A1 | 7/2013 | Collins et al. |
| 2013/0299047 | A1 | 11/2013 | Fabijanic |

FOREIGN PATENT DOCUMENTS

| | | |
|---|---|---|
| DE | 3110488 | 9/1982 |
| DE | 3217295 | 12/1982 |
| DE | 4236081 | 5/1994 |
| DE | 10254846 | 6/2004 |
| DE | 10322563 | 11/2004 |
| DE | 10322255 | 12/2004 |
| DE | 102004009288 | 9/2005 |
| DE | 102005058903 | 7/2006 |
| DE | 102005061946 | 8/2006 |
| DE | 102008053310 | 4/2010 |
| DE | 112008001105 | 6/2010 |
| DE | 102010003902 | 6/2011 |
| EP | 147845 | 7/1985 |
| EP | 242089 | 10/1987 |
| EP | 465333 | 1/1992 |
| EP | 532386 | 3/1993 |
| EP | 787817 | 8/1997 |
| EP | 947600 | 10/1999 |
| EP | 960951 | 12/1999 |
| EP | 1080243 | 3/2001 |
| EP | 818555 | 7/2001 |
| EP | 1162279 | 12/2001 |
| EP | 1193413 | 4/2002 |
| EP | 1247875 | 10/2002 |
| EP | 1306462 | 5/2003 |
| EP | 1432841 | 6/2004 |
| EP | 1482060 | 12/2004 |
| EP | 1544317 | 6/2005 |
| EP | 1550736 | 7/2005 |
| EP | 1642995 | 4/2006 |
| EP | 1558781 | 10/2006 |
| EP | 1757711 | 2/2007 |
| EP | 1847630 | 10/2007 |
| EP | 1847631 | 10/2007 |
| EP | 1889929 | 2/2008 |
| EP | 1905862 | 4/2008 |
| EP | 1980630 | 10/2008 |
| EP | 2128301 | 12/2009 |
| EP | 2133435 | 12/2009 |
| EP | 2284286 | 2/2011 |
| EP | 2284287 | 2/2011 |
| EP | 2322687 | 5/2011 |
| FR | 2792339 | 10/2000 |
| FR | 2827875 | 1/2003 |
| FR | 2832735 | 5/2003 |
| FR | 2909100 | 5/2008 |
| GB | 785878 | 11/1957 |
| GB | 852108 | 10/1960 |
| GB | 1066134 | 4/1967 |
| GB | 2333782 | 8/1999 |
| JP | 9-71853 | 3/1997 |
| JP | 9-268364 | 10/1997 |
| JP | 2753647 | 3/1998 |
| JP | 2963869 | 8/1999 |
| JP | 3046293 | 3/2000 |
| JP | 3100342 | 8/2000 |
| JP | 2000-336469 | 12/2000 |
| JP | 3302967 | 4/2002 |
| JP | 3303741 | 5/2002 |
| JP | 3310797 | 5/2002 |
| JP | 2002-363726 | 12/2002 |
| JP | 2003-119558 | 4/2003 |
| JP | 2003-171756 | 6/2003 |
| JP | 3442447 | 6/2003 |
| JP | 3442737 | 6/2003 |
| JP | 3445968 | 6/2003 |
| JP | 3559048 | 5/2004 |
| JP | 2004-332074 | 11/2004 |
| JP | 2004-332075 | 11/2004 |
| JP | 3661868 | 4/2005 |
| JP | 2005-325371 | 11/2005 |
| JP | 2006-183095 | 7/2006 |
| JP | 3839615 | 8/2006 |
| JP | 3852010 | 9/2006 |
| JP | 3854851 | 9/2006 |
| JP | 2006-322036 | 11/2006 |
| JP | 3931276 | 3/2007 |
| JP | 3996482 | 8/2007 |
| JP | 2007-308792 | 11/2007 |
| JP | 4041602 | 11/2007 |
| JP | 4050512 | 12/2007 |
| JP | 4254816 | 2/2009 |
| JP | 4255815 | 2/2009 |
| JP | 2009-057597 | 3/2009 |
| JP | 2008-163304 | 4/2009 |
| JP | 2009-084607 | 4/2009 |
| JP | 4292280 | 4/2009 |
| JP | 2009-114488 | 5/2009 |
| JP | 4310776 | 5/2009 |
| JP | 2009-138207 | 6/2009 |
| JP | 4322093 | 6/2009 |
| JP | 4350968 | 7/2009 |
| JP | 4354277 | 8/2009 |
| JP | 4381381 | 10/2009 |
| JP | 2010-007117 | 1/2010 |
| JP | 4458079 | 2/2010 |
| JP | 2008-069436 | 3/2010 |
| JP | 2010-053431 | 3/2010 |
| JP | 4092074 | 3/2010 |
| JP | 2010-090437 | 4/2010 |
| JP | 4518604 | 5/2010 |
| JP | 4164995 | 8/2010 |
| JP | 4169864 | 8/2010 |
| JP | 2008-208403 | 9/2010 |
| JP | 4188307 | 9/2010 |
| JP | 2008-538386 | 10/2010 |
| JP | 2010-222636 | 10/2010 |
| JP | 4605718 | 10/2010 |

(56) References Cited

FOREIGN PATENT DOCUMENTS

| | | |
|---|---|---|
| JP | 2008-280610 | 11/2010 |
| JP | 4627776 | 11/2010 |
| JP | 4629064 | 11/2010 |
| JP | 2011-017040 | 1/2011 |
| JP | 4655528 | 1/2011 |
| JP | 2011-149061 | 8/2011 |
| JP | 2011-157598 | 8/2011 |
| JP | 2011-190513 | 9/2011 |
| JP | 4876668 | 12/2011 |
| WO | 03/048405 | 6/2003 |
| WO | 03/050321 | 6/2003 |
| WO | 03/097893 | 11/2003 |
| WO | 2004/007789 | 1/2004 |
| WO | 2004/031432 | 4/2004 |
| WO | 2004/035853 | 4/2004 |
| WO | 2005/038076 | 4/2005 |
| WO | 2005/118904 | 12/2005 |
| WO | 2006/009720 | 1/2006 |
| WO | 2006/136166 | 12/2006 |
| WO | 2007/034911 | 3/2007 |
| WO | 2007/039468 | 4/2007 |
| WO | 2007/110905 | 10/2007 |
| WO | 08/124238 | 10/2008 |
| WO | 2009/082180 | 7/2009 |
| WO | 2009/119529 | 10/2009 |
| WO | 2009/131202 | 10/2009 |
| WO | 2010/138369 | 12/2010 |
| WO | 2011/009463 | 1/2011 |
| WO | 2011/013559 | 2/2011 |
| WO | 2011/017495 | 2/2011 |
| WO | 2011/029565 | 3/2011 |

OTHER PUBLICATIONS

Office action from Japanese Application No. 2012-523940 dated May 13, 2014, 11 pgs.

Examination Report from Australian Application No. 2010279452 dated 3 Oct. 2014, 3 pgs.

Office action from U.S. Appl. No. 13/733,939 dated Jun. 04, 2015.

Office action from Chinese Application No. 201080035086.1 dated Jun. 9, 2015.

* cited by examiner

LOW TEMPERATURE CARBURIZATION UNDER SOFT VACUUM

CROSS-REFERENCE TO RELATED APPLICATION

This application is based on and claims priority to Application Ser. No. 61/232,148, filed Aug. 7, 2009, the discourse of which is incorporated herein by reference.

BACKGROUND

Conventional Carburization

Traditional (high temperature) carburization is a widely used industrial process for enhancing the surface hardness of shaped metal articles ("case hardening"). In a typical commercial process, the workpiece is contacted with a carbon containing gas at elevated temperature whereby carbon atoms liberated by decomposition of the gas diffuse into the workpiece's surface. Hardening occurs through the reaction of these diffused carbon atoms with one or more metals in the workpiece thereby forming distinct chemical compounds, i.e., carbides, followed by precipitation of these carbides as discrete, extremely hard, crystalline particles in the metal matrix forming the workpiece's surface. See, Stickels, "Gas Carburizing", pp 312 to 324, Volume 4, *ASM Handbook,* ©1991, ASM International.

In the last few years, new methods have been introduced for carrying out traditional carburization in which acetylene supplied at very low pressures is used as the carburizing gas. A primary benefit claimed for this approach is that the amount of by-product soot that is formed as part of the carburization reaction is reduced. See, EP 818 555 and corresponding U.S. Pat. No. 5,702,540. In some instances, acetylene flow to the reaction chamber is pulsed rather than constant, as this is said to reduce soot formation even further.

Stainless steel is "stainless" because of the coherent, impervious layer of chromium oxide which inherently forms on the surface of the steel as soon as it is exposed to the atmosphere. When stainless steel is traditionally carburized, the chromium content of the steel is depleted through the formation of the carbide precipitates responsible for surface hardening. As a result, there is insufficient chromium in the steel, at least in areas immediately surrounding the chromium carbide precipitates, to form this chromium oxide protective coating. For this reason, stainless steel is rarely case hardened by conventional carburization, since the corrosion resistance of the steel is compromised.

Low Temperature Carburization

In the mid 1980's, a technique for case hardening stainless steel was developed in which the workpiece is contacted with a carbon containing gas at low temperature, typically below ~550° C. (~1000° F.). At these temperatures, and provided that carburization does not last too long, carbon atoms liberated by decomposition of the gas diffuse into the workpiece surfaces, typically to a depth of 20-50μ, without formation of carbide precipitates. Nonetheless, an extraordinarily hard case (surface layer) is obtained. Because carbide precipitates are not produced, the corrosion resistance of the steel is unimpaired, even improved. This technique, which is referred to a "low temperature carburization," is described in a number of publications including U.S. Pat. No. 5,556,483, U.S. Pat. No. 5,593,510, U.S. Pat. No. 5,792,282, U.S. Pat. No. 6,165,597, EPO 0787817, Japan 9-14019 (Kokai 9-268364) and Japan 9-71853 (Kokai 9-71853).

Original thinking was that surface hardening occurs in low temperature carburization due solely to the stress placed on the crystal lattice of the metal by the carbon atoms which have diffused into this lattice. However, recent analytical work suggests that an additional phase or phases may be formed in this hardened surface layer. While the exact nature of these additional phases is still unknown, what is known is that the chromium content of these additional phases is identical to that of the surrounding metal matrix. The result is that the corrosion resistance of the steel remains unimpaired, because the chromium responsible for corrosion resistance remains uniformly distributed throughout the metal.

Because the temperatures involved in low temperature carburization are so low, carbon atoms will not penetrate the steel's chromium oxide protective coating. Therefore, low temperature carburization of stainless steel is normally preceded by an activation step in which the workpiece is contacted with a halogen containing gas such as HF, HCl, $NF_3$, $F_2$ or $Cl_2$ at elevated temperature, e.g., 200 to 400° C., to make the steel's protective oxide coating transparent to carbon atoms.

Clean UP

Low temperature carburization normally produces soot as an unwanted by-product. In addition, low temperature carburization also produces an undesirable, porous "thermal" oxide film on the outermost surfaces of the workpiece about 20-30 nm thick. See, Japan 9-71853 (Kokai 9-71853). In addition, under this thermal oxide film, an extremely thin outer surface layer of the metal may contain a small amount of carbide precipitates, especially if the low temperature carburization conditions are too severe. See, U.S. Pat. No. 5,556,483, U.S. Pat. No. 5,593,510 and U.S. Pat. No. 5,792,282. In order for the workpiece to exhibit an attractive shiny, metallic appearance, this soot and outermost thermal oxide film must be removed. Therefore, as a practical matter, these undesirable surface layers (i.e., the soot, thermal oxide film, and thin outermost metal layer containing carbide precipitates, if any) are removed before the workpiece is used. Normally, only a minimum amount of the workpiece's metal surface is removed, about 1 micron or so, since the hardened "case" produced by low temperature carburization only extends down to the first 10-25 microns or so of the workpiece's surface.

In any event, in the context of this disclosure, reference to a workpiece surface layer which is "essentially free of carbide precipitates" or which is made "without formation of carbide precipitates" refers to the corrosion-resistant, carbon-hardened surface layer underneath these unwanted by-product layers. For convenience, this corrosion-resistant, hardened byproduct-free surface layer is referred to herein as the "primary" surface layer of the workpiece.

Acetylene

WO 2006/136166, the entire disclosure of which is incorporated herein by reference, describes a low temperature carburization process in which acetylene is used as the carbon source for the carburization reaction. If desired, hydrogen ($H_2$) can be included in the carburizing gas to facilitate decomposition of the acetylene and make control of the process easier. As further described there, decomposition of the acetylene for carburization also activates the chromium oxide coating, thereby rendering a separate activation step unnecessary. Although carburization at "sub-atmospheric pressure" is "contemplated," all working examples are done at conventional pressures.

U.S. Pat. No. 7,122,086 to Tanaka et al., the entire disclosure of which is also incorporated herein by reference, describes a similar low temperature carburization process in which a stainless steel workpiece, after first being activated by contact with a fluorine containing gas, is carburized by contact with acetylene in a hard vacuum, i.e., at a total pressures of 1 torr (133 Pa (Pascals)) or less. A primary benefit claimed for this approach is that the production of soot and undesirable thermal oxide film byproducts is substantially reduced. Nonetheless, the carburized workpiece obtained still needs to be treated, mechanically and/or chemically, to remove these byproduct layers before a usable, final product is obtained.

SUMMARY

In this invention, a stainless steel workpiece is also low temperature carburized by contact with acetylene in a vacuum. However, in this invention, a soft vacuum is used, i.e., a total reaction pressure of about 3.5 to 100 torr (~500 to ~13,000 Pa (Pascals)). In addition, the acetylene is kept at a partial pressure of about 0.5 to 20 torr (~67 to ~2,666 Pa). In addition, a companion gas such as hydrogen ($H_2$) is included in the system. In accordance with this invention it has been found that, by following this approach, the production of soot and thermal oxide film are eliminated virtually completely. As a result, final useful carburized products can be obtained without the post removal treatments previously necessary for producing "surface-clean" products having the attractive shiny, metallic appearance desired.

Thus, this invention provides a process for surface hardening a workpiece made from an iron, nickel and/or chromium based alloy by gas carburization in which the workpiece is contacted with a carburizing gas at an elevated carburization temperature to cause carbon to diffuse into the workpiece surfaces thereby forming a hardened primary surface layer essentially free of carbide precipitates, wherein the carburizing specie in the carburizing gas is an unsaturated hydrocarbon, the partial pressure of the carburizing specie in the carburizing gas is about 0.5 to 20 torr (~67 to ~2,666 Pa), the total pressure of the carburizing gas is about 3.5 to 100 torr (~500 to ~13,000 Pa), and the carburizing gas also contains hydrogen or other companion gas.

More specifically, this invention provides a process for producing a surface-hardened, corrosion-resistant stainless steel workpiece exhibiting a shiny metallic appearance without requiring removal of byproduct soot or thermal oxide from the workpiece surfaces, the process comprising contacting the workpiece with a carburizing gas under conditions of time and temperature which are sufficient to cause carbon to diffuse into the workpiece surfaces thereby forming a hardened primary surface layer essentially free of carbide precipitates but insufficient to cause byproduct soot or thermal oxide to form to any significant degree, wherein the carburizing gas comprises acetylene and hydrogen, the partial pressure of acetylene in the carburizing gas is about 0.5 to 20 torr (~67 to ~2,666 Pa), the total pressure of the carburizing gas is about 3.5 to 100 torr (~500 to ~13,000 Pa), and the molar ratio of hydrogen to acetylene in the carburizing gas is at least 2:1.

DETAILED DESCRIPTION

Alloys

While this invention will normally be carried out on stainless steels, it can also be used on workpieces made from other iron, nickel, cobalt and/or chromium-based alloys. Such materials are well known and described for example in the above-noted U.S. Pat. No. 5,792,282, U.S. Pat. No. 6,093,303, U.S. Pat. No. 6,547,888, EPO 0787817 and Japanese Patent Document 9-14019 (Kokai 9-268364).

Particular alloys of interest are steels, especially steels containing 5 to 50, preferably 10 to 40, wt. % Ni. Preferred alloys contain 10 to 40 wt. % Ni and 10 to 35 wt. % Cr. More preferred are the stainless steels, especially the AISI 300 series steels. Of special interest are AISI 301, 303, 304, 309, 310, 316, 316L, 317, 317L, 321, 347, CF8M, CF3M, 254SMO, A286 and AL6XN stainless steels. The AISI 400 series stainless steels and especially Alloy 410, Alloy 416 and Alloy 440C are also of special interest.

Particular nickel-based alloys which can be low temperature carburized in accordance with this invention include Alloy 600, Alloy 625, Alloy 825, Alloy C-22, Alloy C-276, Alloy 20 Cb and Alloy 718, to name a few examples.

In addition to iron- and nickel-based alloys, low temperature carburization in accordance with the present invention can also be practiced on cobalt-based alloys as well as manganese-based alloys. Examples of such cobalt-based alloys include MP35N and Biodur CMM, while examples of such manganese-based alloys include AISI 201, AISI 203EZ and Biodur 108.

Low temperature carburization in accordance with the present invention can also be practiced on various duplex steels including Alloy 2205, Alloy 2507, Alloy 2101 and Alloy 2003, for example, as well as on various age hardenable alloys such as Alloy 13-8, Alloy 15-5 and Alloy 17-4, for example.

The particular phase of the metal being processed in accordance with the present invention is unimportant, as the invention can be practiced on metals of any phase structure including, but not limited to, austenite, ferrite, martensite, duplex metals (e.g., austenite/ferrite), etc.

Carburization Reactor

Most commonly, carburization is done by placing the workpiece in a carburization reactor, evacuating the reactor to the desired level of vacuum, and then supplying a carburization gas to the reactor at a suitable flowrate while maintaining the desired level of vacuum in the reactor. The carburization gas that the workpiece actually comes into contact with during carburization is controlled by controlling the flowrate of the carburizing gas and/or its components fed to the reactor as well as the level of vacuum inside the reactor.

Other techniques for contacting the workpiece with the carburization gas can, of course, be used.

Carburization Temperature

Conventional low temperature carburization is normally carried out at reaction temperatures below 550° C., normally about 450° C. to 525° C. In contrast, modified low temperature carburization processes in which acetylene or analogue is used as the carbon source can be carried out at lower temperatures, typically on the order of 350° C. to 510° C., but more commonly 350° C. to 450° C., because unsaturated hydrocarbons are so active.

Any of these carburization temperatures can be used in the inventive process, if desired. However, the lower carburization temperature described above, 350° C. to 510° C., more commonly 350° C. to 450° C., will normally be employed because they allow better control of the carburization reaction and result in less soot production.

Carburizing Gas

In accordance with this invention, the workpiece to be carburized is contacted with a carburizing gas containing acetylene or analogue as the carburization specie. In this context, "carburization specie" refers to the carbon containing compound in the carburizing gas which decomposes to yield elemental carbon for the carburization reaction.

In addition to acetylene, essentially any other unsaturated hydrocarbon ("acetylene analogue") can be used as the carburizing specie in this invention including hydrocarbons with ethylenic unsaturation, hydrocarbons with acetylenic unsaturation and hydrocarbons with aromatic unsaturation. In this context, "hydrocarbon" has its ordinary meaning, i.e., a compound composed of carbon and hydrogen only, with no other element being present. For example, ethylenically unsaturated hydrocarbons including monoolefins and polyolefins, both conjugated and unconjugated, can be used. Ethene (ethylene), propene (propylene), butene, and butadiene are good examples. Acetylenically unsaturated hydrocarbons such as acetylene and propyne ($C_3H_4$) can also be used. Acetylene and $C_1$-$C_6$ ethylenically unsaturated compounds are of special interest because of low cost and ready availability. Mixtures of these compounds can also be used.

In addition to this carburizing specie, the carburization gas used in the inventive process also includes a companion gas. In this context, a "companion gas" will be understood to mean any gas which will readily react with oxygen under the reaction conditions encountered during the carburization reaction and, in addition, which is not an unsaturated hydrocarbon. Hydrogen ($H_2$) is preferred since it is inexpensive and readily available. Natural gas, propane, other $C_1$-$C_6$ alkanes and other saturated hydrocarbons are also believed to be suitable for this purpose, as they readily react with oxygen at the elevated temperatures involved in low temperature carburization. On the other hand, nitrogen and the other inert gases are not suitable for this purpose, since they do not react with oxygen under these conditions. In addition, acetylene and other unsaturated hydrocarbons are not "companion gases" within the meaning of this disclosure, because they serve as the active carburizing specie.

In addition to the carburizing specie and companion gas, the carburizing gas used in the inventive process can also contain still other ingredients in accordance with conventional practice. Thus, for example, the carburization gas can contain a suitable inert diluent gas such as nitrogen, argon and the like. Other gases can also be used, it being desirable to avoid using compounds containing significant amounts of oxygen, nitrogen, boron and/or any other non-inert element (other than carbon and hydrogen) to avoid introducing such elements into the workpiece.

Vacuum Conditions

In accordance with this invention, low temperature carburization using acetylene or analogue as the carburizing specie is carried out under soft vacuum conditions with a carburizing gas that also contains a companion gas. In this context, "soft vacuum" will be understood to mean a total system pressure of about 3.5 to 100 torr (~500 to ~13,000 Pa). In accordance with this invention it has been found that, when low temperature carburization of stainless steel is carried out in this way, formation of byproduct soot and undesirable thermal oxide film that normally occurs during conventional low temperature carburization can be eliminated virtually completely. Thus, it is possible in accordance with this invention to produce finished low temperature carburized stainless steel products having the attractive shiny, metallic appearance desired without the cleaning step or steps normally undertaken to remove these unwanted byproducts.

As indicated above, U.S. Pat. No. 7,122,086 to Tanaka et al. describes low temperature carburizing stainless steel by contact with acetylene in a hard vacuum, i.e., at a total pressures of 1 torr (~133 Pa (Pascals)) or less. Although this approach reduces formation of byproduct soot and thermal oxide film, enough of these undesirable by-products remain so that the carburized workpiece still needs to be cleaned, mechanically and/or chemically, before a final product is obtained. Although not wishing to be bound to any theory, it is believed this result is due at least in part to the contaminants found in the so-called "Beilby" layer of the workpiece, i.e., the amorphous layer up to about 2.5 microns thick formed on the outermost surface of the steel by disorientation of its crystal structure during polishing, machining or other surface disruptive manufacturing technique. In addition to a fractured grain structure, the Beilby layer is also known to contain contaminates picked up during manufacture of the steel including oxygen, moisture, lubricants, etc. In accordance with this aspect of the invention, it is believed that these contaminants, especially water and oxygen, can participate in the formation of a thermal oxide film byproduct during conventional low temperature carburization.

In accordance with this invention, therefore, carburization is carried out under "soft vacuum" conditions involving a significantly higher total pressure (~3.5 torr minimum versus 1 torr maximum in Tanaka) in the presence of a substantial amount of hydrogen or other companion gas. As a result, it is believed that these contaminants, especially water and oxygen, are prevented from promoting formation of the thermal oxide film byproduct because of the more intense reducing conditions created by the combination of this companion gas together with the decomposing acetylene. In any event, it has been found in accordance with this invention that, so long as (1) the total pressure of the carburizing gas is about 3.5 to 100 torr (~500 to ~13,000 Pa), (2) the partial pressure of acetylene or analogue in the carburizing gas is about 0.5 to 20 torr (~67 to ~2,666 Pa), and (3) a substantial amount of companion gas is included in the carburizing gas, formation of by-product soot and thermal oxide film is eliminated virtually completely.

The reason why the minimum total pressure of the carburizing gas is at least about 3-4 torr (~500 Pa) is that significantly lower pressures promote formation of the unwanted thermal oxide layer byproduct.

The reason why the maximum total pressure of the carburizing gas is about 100 torr (~13,000 Pa) is that significantly higher pressures also promote formation of the unwanted thermal oxide layer byproduct. In this regard, essentially all industrial gases available at commercially feasible prices contain at least some level of oxygen and moisture contamination. As the total pressure of the carburizing gas begins to exceed about 100 torr (~13,000 Pa), formation of the unwanted thermal oxide layer byproduct from the moisture and/or oxygen contaminants in the gases used in the inventive process begins to be significant. Therefore, the total pressure of the carburizing gas used in the inventive process is desirably held at or below about 100 torr (~13,000 Pa) to minimize formation of this undesirable byproduct from these moisture and/or oxygen contaminants.

The reason why the minimum partial pressure of acetylene or analogue in the carburizing gas is about 0.5 torr (~67 Pa), is that significantly lower partial pressures provide insufficient carburization under the "soft vacuum" conditions used in the inventive system.

Finally, the reason why the maximum partial pressure of acetylene or analogue in the carburizing gas is about 20 torr (~2,666 Pa), is that significantly higher partial pressures promote excessive soot formation.

Generally speaking, therefore, the total pressure of the carburizing gas used in the inventive process will normally be about 3.5 to 100 torr (~500 to ~13,000 Pa). Total pressures on the order of 4 to 75 torr (~533 to ~10,000 Pa), 4.5 to 50 torr (~600 to ~6,666 Pa), 5 to 25 torr (~666 to ~3,333 Pa), 5.5 to 15 torr (~733 to ~2,000 Pa), and even 6 to 9 torr (~80 to ~1,200 Pa), are desirable. Similarly, partial pressures of acetylene or analogue in the carburizing gas will normally be about 0.5 to 20 torr (~67 to ~2,666 Pa). Partial pressures on the order of 0.6 to 15 torr (~80 to ~2,000 Pa), 0.7 to 10 torr (~93 to ~1,333 Pa), 0.8 to 5 torr (~107 to ~666 Pa) and 0.9 to 2.1 torr (~120 to ~280 Pa) are more interesting. This means that the concentration of acetylene or other carburizing specie will generally be about ≤50 vol. %, ≤40 vol. %, ≤35 vol. %, or even ≤30 vol. %, based on the carburization gas as a whole, with concentrations on the order of 3 to 50 vol. %, 4 to 45 vol. %, 7 to 40 vol. %, and even 10 to 35 vol. %, being more common. Systems in which total pressure is about 5 to 25 torr (~666 to ~3,333 Pa), or even 6 to 9 torr (80-1,200 Pa), and the concentration of carburization specie is about 7 to 40 vol. % or even 10 to 35 vol. %, are more interesting.

As indicated above, the carburizing gas used in the inventive process also contains a significant amount of companion gas, preferably hydrogen, $H_2$. As further indicated above, the function of this companion gas is to make the reducing conditions seen by the workpiece more intense than would otherwise be the case, it having been found that the presence of this companion gas in combination with the acetylene already in the system eliminates formation of unwanted thermal oxide byproduct film virtually completely, at least when the inventive process is carried out under the soft vacuum conditions described above. Accordingly, the amount of hydrogen or other companion gas included in the carburizing gas of this invention should be enough to accomplish this function.

In practical terms, this means that the entire remainder of the carburizing gas, i.e., all of the carburizing gas not composed of acetylene or analogue, will normally be composed of hydrogen or other companion gas. This is because, at the relatively low total reaction pressures involved in the inventive process, 3.5 to 100 torr (~500 to ~13,000 Pa), the total amount of this remainder is relatively small. Therefore, there is no real economic advantage to be gained in introducing nitrogen or other inert gas into the system as a practical matter.

The above-noted WO 2006/136166 indicates that nitrogen ($N_2$) in addition to hydrogen ($H_2$) can be included in its acetylene-based carburizing gas. However, the carburization process described there is carried out at or near atmospheric pressure. At such relatively high pressures, it makes sense to include a significant amount nitrogen in the carburizing gas not only to reduce consumption of expensive hydrogen but also to help control the carburization reaction and reduce soot production.

The inventive process, however, is carried out at much lower total pressure, about 100 torr (~13,000 Pa) or less. At these much lower pressures, the expense of hydrogen consumption becomes less significant. In addition, control of the reaction is naturally easier because of the inherently smaller amounts of acetylene and hydrogen present due to this much lower pressure. In addition, production of unwanted soot is inherently less. The practical result is that including nitrogen or other inert gas in the system to reduce costs, aid reaction control and reduce soot production is unnecessary as a practical matter. Therefore, the most practical way of carrying out the inventive process is to make up the entire remainder of the carburizing gas, i.e., all of the carburizing gas not composed of acetylene or analogue, from hydrogen ($H_2$) or other companion gas. On the other hand, nitrogen or other inert gas can be included in the system, if desired, so long as enough hydrogen or other companion gas remains in the system to achieve its function as described above, i.e., to retard formation of the thermal oxide byproduct layer.

In practical terms, this means that the amount of hydrogen or other companion gas in the carburizing gas will normally be at least about twice the amount of acetylene or analogue. In other words, the ratio of the partial pressure of hydrogen or other companion gas to acetylene or analogue will normally be at least about 2. Partial pressure ratios of ≥4, ≥5, ≥7, ≥10, ≥15, ≥20, ≥25, ≥50 and even ≥100 are contemplated.

Activation

As indicated above, before stainless steel can be low temperature carburized, it is normally treated to render its coherent chromium oxide protective coating transparent to carbon atoms. Usually, this is done by contact of the workpiece with an activating gas comprising a halogen containing gas, e.g., HF, HCl, $NF_3$, $F_2$ or $Cl_2$, at elevated temperature, e.g., 200 to 400° C., usually at pressures at or near atmospheric pressure. Most conveniently, activation is done in the same reactor as carburization without removing the workpiece from the reactor or otherwise exposing the workpiece to the atmosphere between activation and carburization, since this allows the less expensive and easier to handle chlorine based compounds such as HCl to be used. Any of these conventional approaches can also be used to activate stainless steel workpieces to be low temperature carburized by the inventive process.

In accordance with another embodiment of this invention, activation is done not only in the same reactor as carburization without removing the workpiece from the reactor or otherwise exposing the workpiece to the atmosphere between activation and carburization, but also under a similar regimen of conditions as that involved in the carburization reaction, i.e., under essentially the same "soft" vacuum, at essentially the same temperature, and in the presence of the same companion gas as used in the carburization step. The advantage of this approach is that it greatly facilitates control over the overall process, because the temperature and overall pressure inside the reactor can be kept the essentially the same with only the flows of chemically active gases, i.e., the activating gas in the activating step, the carburizing specie in the carburization step (and possibly the companion gas, if desired) being changed. This, in turn, significantly reduces the magnitude of gas flow changes needed to switch between activation and carburization, which makes overall control of the system easier. This ease of control is particularly advantageous in certain additional embodiments of this invention in which the workpiece is subjected to alternating cycles of activation and carburization, as further discussed below.

In this embodiment, the reaction temperature during both activation and carburization is normally kept essentially the same, since this most convenient. Although these temperatures, e.g., 350° C. to 450° C. or even 510° C., are higher than normally encountered in conventional activation for low temperature carburization (200° C. to 400° C.), they are nonetheless effective especially if the activating gas is somewhat diluted as further discussed below. Different temperatures can also be used for activation and carburization, although there is no particular advantage in doing so. If different temperatures are used, the difference will normally be no more than about 100° C., 50° C., 25° C., or even 10° C.

With respect to reaction pressure, activation can be done at any pressure including atmospheric pressure, subatomospheric pressure and superatmospheric pressure, if desired. However, in accordance with this embodiment, activation is preferably done at or near the "soft vacuum" pressures used in the carburization step, i.e., 3.5 to 100 torr (~500 to ~13,000 Pa), 4 to 75 torr (~533 to ~10,000 Pa), 4.5 to 50 torr (~600 to ~6,666 Pa), 5 to 25 torr (~666 to ~3,333 Pa), 5.5 to 15 torr (~733 to ~2,000 Pa), or even 6 to 9 torr (~80 to ~1,200 Pa).

Two different approaches are typical. In a first approach to pressure, the overall reaction pressure is kept essentially the same with the flowrate of the companion gas (and inert gas in the system, if any) varied to take into account the different flow rates of the chemically active gases. In this regard, the concentration of acetylene or other carburizing specie in the carburization gas will normally be somewhat higher than the concentration of the activating gas in the activating gas mixture. Therefore, if this approach is used, the flowrate of the companion gas is decreased when switching from activation to carburization to account for the increased flow of chemically active gas. Conversely, the flowrate of companion gas is increased when switching from carburization to activation to account for the decreased flow of chemically active gas.

Although the reaction pressure is kept essentially the same during both activation and carburization in this approach, variations in pressure are possible. If different pressures are used, the difference between these pressures will normally be no more than about 20 torr, 15 torr, 10 torr or even 5 torr.

In the second approach to pressure, the flow rate of the companion gas is kept the same with the overall pressure changing to accommodate the change in the total amount of gas fed to the reactor. As indicated above, the concentration of acetylene or other carburizing specie in the carburization gas will normally be somewhat higher than the concentration of the activating gas in the activating gas mixture. Therefore, if this approach is used, the overall absolute pressure inside the reaction chamber will be relatively higher during carburization, due to a greater overall amount of gas being fed to the reactor during this procedure, and relatively lower during activation, due to a lesser overall amount of gas being fed to the reactor during this procedure.

In this approach, the change in reaction pressure will be directly proportional to the change in total gas flowrate to the reactor. For example, if the flowrate of the total amount of gases fed to the reactor increases by 10% when switching from activation to carburization, the absolute pressure in the reactor after steady state is reached will also increase by 10%. However, variations in this change to reaction pressure can be used, if desired. If variations are desired, variations from this steady state pressure of ±20%, ±15%, ±10%, and even ±5%, can be used.

A hybrid of the above two pressure approaches can also be used, if desired. That is to say, the total flowrate of the companion gas can be varied when switching from activation to carburization and from carburization to activation, but not so much that the reaction pressure remains constant. This hybrid approach may be more convenient in commercial operations in which much bigger reaction vessels are used, since it reduces the precision that is necessary for pressure control. So long as the pressure inside the reactor is kept between the steady state pressures that would be established by the first pressure approach and the second pressure approach, the advantages of this embodiment of the invention will be realized.

As for the activating gas used in this embodiment, it can be used "neat," i.e., without any other gas being present, if desired. Normally, however, it will be combined with the same companion gas (and inert gas, if any) used in the carburization step, as described above, since this is most convenient. As in the case of carburization, however, there is no real economic or technical advantage to including an inert gas in the system because of the low pressures involved, and so inert gases will normally not be used.

In any event, when a companion gas (and inert gas, if any) is combined with the activating gas, any suitable concentration of activating gas can be included in the activating gas mixture, i.e., the mixture of activating gas and companion gas. The particular concentration to use in particular embodiments depends on a number factors including the severity of the activation conditions desired, the time allotted for the activation procedure, the desired similarity between the activation and carburization steps in terms of flow rate of the companion gas, etc., and can easily be determined by routine experimentation. Concentrations of activating gas in the activating gas mixture of 0.1 vol. % to 30 vol. %, 0.5 vol. % to 10 vol. %, and even 1 vol. % to 5 vol. % are typical.

Pulsing the Activating Gas

In accordance with yet another feature of this invention, the supply of activating gas to the reactor is pulsed. In other words, the flowrate of this activating gas is pulsed between higher and lower values (including zero) during the activating step. It is believed this approach will enable the activation time to be shortened even more compared with standard practice.

Pulsing the activating gas can be done in a variety of different ways. For example, where the activating gas is used "neat," i.e., without diluents, the activating gas can be pulsed by repeatedly changing the flowrate of the activating gas to the reactor between higher and lower values. Moreover, the levels of these higher and lower values can be increased or decreased over the course of the activation procedure, if desired, to achieve a corresponding increase or descries in the severity of the activating conditions seen by the workpiece. In the same way, the duration of each pulse, the frequency of each pulse, or both, can be increased or decreased over the course of the activation procedure, if desired, to achieve a corresponding increase or decrease in the severity of the activating conditions seen by the workpiece.

The same approach can also be used in those situations in which the activating gas is combined with a companion gas and optional inert gas, as discussed above. For example, the concentration of activating gas in the activating gas mixture can be pulsed between higher and lower values and/or the flow rate of the activating gas fed to the reactor can be changed between higher and lower values. Similarly, the severity of the activation conditions can be increased or decreased over the course of the activation procedure, if desired, by changing the magnitude, frequency and/or duration of each pulse.

Changing the Carburization Potential

In our earlier U.S. Pat. No. 6,547,888, the disclosure of which is also incorporated herein by reference in its entirety, we describe a modified low temperature carburization process in which the carburization potential seen by the stainless steel workpiece is changed over the course of the carburization reaction. Provided that this change is done in an appropriate way, we found that the overall carburization reaction can be done faster, the production of soot reduced, or both, relative to conventional practice.

As described there, these changes in the carburization potential include (1) lowering the carburization temperature, (2) lower the concentration of carburizing specie in the carburizing gas, (3) interrupting the carburization process while maintaining the workpiece at elevated temperature, and (4) interrupting the carburization process as in (3) but also reactivating the workpiece during this interruption by contact with a halogen containing gas.

In accordance with another feature of this invention, we have found that by applying the technology described in our earlier U.S. Pat. No. 6,547,888 to the inventive low temperature carburization processes described here, we can achieve still further improvements in the overall carburization process. Specifically, we have found that by combining these two technologies, a further reduction in the overall time it takes to complete the carburization reaction, a further reduction in the amount of soot produced during the carburization reaction, or both, can be achieved.

As described in our '888 patent, approach (1), i.e., changing the carburization potential by reducing reaction temperature, envisions using higher reaction temperatures than would normally be the case during early stages of carburization followed by lower reaction temperatures at later stages. Similarly, approach (2), i.e., changing the carburization potential by reducing the concentration of carburization specie in the carburization gas, envisions using higher concentrations of carburization specie than would normally be the case during early stages of carburization followed by lower concentrations at later stages. This same departure from "normal" practice is followed in this embodiment as well. In particular, this embodiment can be carried out by first determining a suitable set of "base line" carburization conditions in which the inventive process is carried out with these conditions being held constant during the entire carburization reaction. Then the manner in which the carburization temperature should be lowered, the manner in which the concentration of the carburization specie in the carburization gas should be lowered, or both, can be determined using these base line carburization conditions as a guide. This can be easily done by routine experimentation.

Similarly, how to adopt approach (3) of the '888 patent (i.e., changing the carburization potential by interrupting carburization while maintaining the workpiece at elevated temperature) to the technology of this invention and how to adopt approach (4) of the '888 patent, (i.e., changing the carburization potential by contacting the workpiece with a halogen containing gas during an interruption in carburization) to the technology of this invention, can also be easily determined by routine experimentation using a base line set of activation conditions and a base line set of carburization conditions determined in the manner described above.

So, for example, a base line set of constant activation and reaction conditions that can be used to low temperature carburize an AISI 316 stainless steel workpiece by the inventive process involves activating the workpiece by contact with 5 liters/min. of an activating gas mixture comprising 1 vol. % hydrogen chloride in hydrogen gas for ¼ to 1 hour in a carburization reactor having an internal volume of 4 cubic feet (~113 liters) at 350° C. to 450° C. and 6 to 8 torr pressure, followed by carburizing the workpiece by contact with a carburization gas comprising 10% to 35% acetylene and the balance hydrogen in the same reactor at a temperature of 350° C. to 450 C and a pressure of 6 to 8 torr for 15 to 30 hours.

With this base line as a guide, the technology of the '888 patent in which the carburization conditions are changed during the course of the carburization reaction can be implemented according to any of the following exemplary modifications:

(a) Same as baseline but with activation of the workpiece being interrupted with a preliminary carburization step carried out in the same way as described above;

(b) Same as baseline or (a) but with the main carburization step (i.e., after activation) being carried out with a ramped acetylene content, i.e., an acetylene content that continuously decreases, for example, starting at 20 vol. % to 35 vol. % then reducing to 10 vol. % by the end of carburization;

(c) Same as baseline or (a) but with carburization carried out with pulsed flow of the carburization gas, each pulse for example involving 1 minute of flow of the acetylene-enriched carburization gas described above followed by 14 minutes of 100% hydrogen gas flow (In this regard, it will be appreciated that pulsed flow of the carburizing gas as described here is just another example of approach (3) of the '888 patent, i.e., changing the carburization potential by interrupting carburization while maintaining the workpiece at elevated temperature);

(d) Same as (c) wherein the concentration of acetylene in the carburization gas is both pulsed and downwardly ramped, for example, by reducing the length of each acetylene enriched pulse from 1 minute in duration during the early stages of carburization to 20 seconds in duration during later stages of carburization;

(e) Same as (c) wherein the concentration of acetylene in the carburization gas is both pulsed and downwardly ramped, with downward ramping of the acetylene concentration being accomplished by decreasing the frequency of the pulses, for example, by increasing the time between pulses from 14 minutes during the early stages of carburization to 29 minutes during the later stages of carburization;

(f) Same as (c) wherein the concentration of acetylene in the carburization gas is both pulsed and downwardly ramped, with downward ramping of the acetylene concentration being accomplished by using pulses of the same duration but reducing the concentration of acetylene in successive pulses, for example, by reducing the acetylene concentration in the carburizing gas from about 20% to 35% during early stages of carburization to 10% during later stages of carburization;

(g) Same as baseline or (a) but with the main carburization step (i.e., after activation) being carried out with a ramped temperature, i.e., a carburization temperature that decreases, for example, starting at 510° C. for 30 min, decreasing to 450° C. for 120 min, followed by a further decrease to 380° C. for the remainder of the carburization step;

(h) Same as baseline or (a) but with carburization carried out with pulsed flow of the carburization gas as in (c) with the carburizing temperature being downwardly ramped as in (g);

(i) Same as (h) but with the concentration of acetylene in the carburization gas also being downwardly ramped as in (e), i.e., by decreasing the frequency of the pulses, for example, by increasing the time between pulses from 14 minutes during the early stages of carburization to 29 minutes during the later stages of carburization;

(j) Same as (h) but with the concentration of acetylene in the carburization gas also being downwardly ramped as in (f), i.e., by reducing the acetylene concentration in the carburizing gas used in each pulse from about 20% to 35% during early stages of carburization to 10% during later stages of carburization.

WORKING EXAMPLES

In order to describe this invention more thoroughly, the following working examples are provided.

Example 1

An AISI 316 stainless steel workpiece, after cleaning to remove organic residue, was placed in a carburizing reactor having an internal volume of 4 cubic feet (~113 liters) which was then evacuated to a hydrogen pressure of 6 torr, while the internal temperature of the reactor was raised to 450° C. The workpiece was then activated by continuously feeding an activating gas comprising 1 vol. % HCl gas in $H_2$ to the reactor at a flow rate of about 5 liter/min. while maintaining the internal temperature of the reactor at 450° C. and the internal pressure of the reactor at 6 torr.

After ¼ hour, and without taking the workpiece out of the reactor or otherwise exposing the workpiece to the atmosphere, the flow of activating gas to the reactor was terminated and replaced with a flow of a 5 liter/min. of a carburizing gas comprising 20 vol. % acetylene in hydrogen ($H_2$) while maintaining the internal temperature of the reactor 450° C. and the internal pressure of the reactor at 6 torr.

These conditions were maintained essentially constant for 1 hour, at which time the above activating and carburization steps were repeated without taking the workpiece out of the reactor or otherwise exposing the workpiece to the atmosphere. That is to say, after the workpiece had been carburized for 1 hour, the first carburization step was terminated and replaced by a second activation step. This was done by terminating the flow of acetylene, and starting a new flow of HCl, and increasing the flow of hydrogen so that the workpiece was subjected to a second activation step essentially the same as the first, i.e., essentially the same time, essentially the same temperature and essentially the same activating gas.

After 1 hour, the second activation step was terminated and the second, main carburization step begun, again without taking the workpiece out of the reactor or otherwise exposing the workpiece to the atmosphere. This was done by terminating the flow of HCl, beginning a new flow of acetylene, and decreasing the flow of hydrogen so that the workpiece was exposed to the same conditions of temperature, pressure and carburizing gas composition as the first carburizing step.

Then, beginning at about 3 hours after the second, main carburization step began, the carburization potential of the carburizing gas was reduced from a higher value during initial stages of carburization to a lower value during later stages of carburization for the purpose of making the entire carburization reaction proceed faster than otherwise would be the case in accordance with our earlier U.S. Pat. No. 6,347,888. This was done by reducing the concentration of acetylene in the carburizing gas in stepped increments, from 20 vol. % to 15 vol. %, starting 3 hours after the second carburization step began, and then again from 15 vol. % to 10 vol. % starting 5 hours after the second carburization step began. Carburization was continued under these conditions (450° C., 6 torr total pressure, acetylene concentration in carburizing gas 10 vol. %, balance hydrogen) for an additional 9 hours, after which carburization was complete.

At this time (14 hours after the second, main carburization step began), the flow of acetylene to the carburization reactor was terminated while the flow rate of hydrogen was continued at 6 torr pressure until the workpiece had cooled to about room temperature. After removal from the reactor, the workpiece so obtained was examined and found to have a hardened surface (i.e., case) approximately 16-18μ, deep essentially free of carbide precipitates and exhibiting a near surface hardness of about 700-800 Vickers. Visual inspection revealed that the workpiece exhibited a bright, shiny metallic surface essentially free of the surface adherent soot and thermal oxide coating that normally forms as a result of low temperature carburization, thereby eliminating the need for any post processing cleaning.

Example 2

Example 1 was repeated except that, during the second, main carburization step a pulsed flow of acetylene was fed to the carburization reactor. Initially, 5 liters/min of a carburizing gas comprising 20 vol. % acetylene/80 vol. % hydrogen was fed to the carburization reactor in 1 minute pulses at a frequency of 1 pulse each 15 minutes. In between each pulse was a 14 minute interval during which the carburizing gas fed to the reactor was 5 liters/min of 100% hydrogen.

1 hour after the second, main carburization step began, the duration of each pulse decreased from 60 seconds to 40 seconds while the duration of each interval increased 20 seconds to keep the frequency of the pulses the same. Then, 3 hours after the second carburization step began, the duration of each pulse decrease again from 40 seconds to 20 seconds while the duration of each interval increased another 20 seconds to keep the frequency of the pulses the same. Carburization continued for another 11½ hours after this second change (14½ hours total in second, main carburization step), after which carburization was complete.

The workpiece was then cooled, removed from the reactor and examined in the same way as in Example 1 above. The low temperature carburized workpiece so obtained was found to have a hardened surface (i.e., case) approximately 15-17μ deep essentially free of carbide precipitates and exhibiting a near surface hardness of about 650-750 Vickers. Visual inspection revealed that this workpiece also was essentially free of surface adherent soot and yellowish thermal oxide exhibiting a bright, shiny metallic surface requiring no post processing cleaning.

Example 3

Example 1 was repeated except that:

(a) during both activation steps, the flow rate of the activating gas to the reactor was about 12 liter/min., (b) the carburizing gas used in the first carburizing step was composed of 10 vol. % acetylene in $H_2$, and (c) the second carburizing step lasting 13.5 hours and used a carburizing gas composed of 10 vol. % acetylene in $H_2$ during the entire second carburization step.

Analysis of the carburized workpiece obtained revealed a hardened surface (i.e., case) approximately 18-20μ deep essentially free of carbide precipitates and exhibiting a near surface hardness of about 800-900 Vickers. Visual inspection revealed that the workpiece exhibited no thermal oxide coating of the type that normally forms as a result of low temperature carburization, but that some surface areas did carry a thin adherent layer of soot.

Example 4

Example 3 was repeated except that the workpiece was made from Alloy 6MO (UNS N08367), which is a highly alloyed stainless steel composed of Ni 25.5/23.5 wt %, Mo 7/6 wt %, N 0.25/0.18 wt %, Fe bal., available from Allegheny Ludlum Corporation under the designation AL6XN. Analysis of the carburized workpiece obtained revealed a hardened surface (i.e., case) approximately 12-14μ deep essentially free of carbide precipitates and exhibiting a near surface hardness of about 900-1000 Vickers. Visual inspection revealed that the workpiece exhibited a bright, shiny metallic surface essentially free of the surface adherent soot and thermal oxide coating that normally forms as a result of low temperature carburization, thereby eliminating the need for any post processing cleaning.

Example 5

Example 3 was repeated except that the activating gas was composed of 1 vol. % HCl in $N_2$. $N_2$ was used as the companion gas in the activating gas in this example, because this approach allows easier processing of the effluent activating gas, in particular by eliminating the need to process the effluent activating gas through an afterburner for combusting unconsumed $H_2$. Analysis of the carburized workpiece obtained revealed a hardened surface (i.e., case) approximately 14-16μ essentially free of carbide precipitates and exhibiting a near surface hardness of about 800-900 Vickers. Visual inspection revealed that the workpiece obtained exhibited no thermal oxide coating of the type that normally forms as a result of low temperature carburization, but that some surface areas did carry a thin adherent layer of soot.

Example 6

Example 4 was repeated except that the activating gas was composed of 1 vol. % HCl in $N_2$. Analysis of the carburized workpiece obtained revealed a hardened surface (i.e., case) approximately 10-14μ deep essentially free of carbide precipitates and exhibiting a near surface hardness of about 700-800 Vickers. Visual inspection revealed that the workpiece exhibited a bright, shiny metallic surface essentially free of the surface adherent soot and thermal oxide coating that normally forms as a result of low temperature carburization, thereby eliminating the need for any post processing cleaning.

Although only a few embodiments of the present invention have been described above, it should be appreciated that many modifications can be made without departing from the spirit and scope of the invention. All such modifications are intended to be included within the scope of the present invention, which is to be limited only by the following claims.

The invention claimed is:

1. A process for surface hardening a workpiece made from stainless steel by gas carburization in which the workpiece is contacted with a carburizing gas at an elevated carburization temperature to cause carbon to diffuse into the workpiece surfaces thereby forming a hardened primary surface layer essentially free of carbide precipitates, wherein (1) the carburizing gas contains a carburizing specie comprising an unsaturated hydrocarbon, (2) the partial pressure of the carburizing specie in the carburizing gas is about 0.5 to 20 torr (~67 to ~2,666 Pa), (3) the total pressure of the carburizing gas is about 3.5 to 100 torr (~500 to ~13,000 Pa), (4) the carburizing gas also contains a companion gas, the companion gas comprising hydrogen, natural gas, propane, another $C_1$-$C_6$ alkane or another saturated hydrocarbon, and (5) the partial pressure of the companion gas in the carburizing gas is at least twice the partial pressure of the carburizing specie.

2. The process of claim 1, wherein the carburizing gas comprises acetylene and hydrogen.

3. The process of claim 1, wherein the carburizing gas is essentially free of an inert gas.

4. The process of claim 1, wherein the total pressure of the carburizing gas is about 5-25 torr (~666 to ~3,333 Pa).

5. The process of claim 4, wherein the total pressure of the carburization gas is about 6-9 torr (800-1,200 Pa) and the concentration of carburization specie in the carburization gas is about 10-33 vol. %.

6. The process of claim 1, wherein the carburization potential of the carburizing gas is changed over the course of the carburization reaction.

7. The process of claim 6, wherein carburization is carried out in a carburization reactor, and further wherein the carburization potential is changed by pulsing the flowrate of carburizing specie to the carburization reactor.

8. The process of claim 6, wherein the carburization potential of the carburizing gas is changed by at least one of (3) interrupting the flow of carburizing specie to the carburization reactor, and (4) interrupting the flow of carburizing specie the carburization reactor and, in addition, contacting the workpiece with a halogen containing gas during this interruption.

9. A process for surface hardening a workpiece made from an iron, nickel or chromium based alloy by gas carburization in which the workpiece is contacted with a carburizing gas at an elevated carburization temperature to cause carbon to diffuse into the workpiece surfaces thereby forming a hardened primary surface layer essentially free of carbide precipitates, wherein (1) the carburizing gas contains a carburizing specie comprising an unsaturated hydrocarbon, (2) the partial pressure of the carburizing specie in the carburizing gas is about 0.5 to 20 torr (~67 to ~2,666 Pa), (3) the total pressure of the carburizing gas is about 3.5 to 100 torr (~500 to ~13,000 Pa), (4) the carburizing gas also contains a companion gas, the companion gas comprising a gas that will react with oxygen under the above elevated carburization temperature and total pressure but which is not an unsaturated hydrocarbon, and (5) wherein the carburization potential of the carburizing gas is changed over the course of the carburization reaction by at least one of (1) reducing the reaction temperature from a higher reaction temperature during an earlier stage of carburization to a lower reaction temperature during a later stage of carburization, and (2) reducing the concentration of carburization specie in the carburization gas from a higher concentration during an earlier stage of carburization to a lower concentration during a later stage of carburization.

10. A process for surface hardening a workpiece made from an iron, nickel or chromium based alloy by gas carburization in which the workpiece is contacted with a carburizing gas at an elevated carburization temperature to cause carbon to diffuse into the workpiece surfaces thereby forming a hardened primary surface layer essentially free of carbide precipitates, wherein (1) the carburizing gas contains a carburizing specie comprising an unsaturated hydrocarbon, (2) the partial pressure of the carburizing specie in the carburizing gas is about 0.5 to 20 torr (~67 to ~2,666 Pa), (3) the total pressure of the carburizing gas is about 3.5 to 100 torr (~500 to ~13,000 Pa), (4) the carburizing gas also contains a companion gas, the companion gas comprising hydrogen, natural gas, propane, another $C_1$-$C_6$ alkane or another saturated hydrocarbon, and (5) the workpiece is activated by contact with an activating gas, with activation and carburization being done in the same reactor without removing the workpiece from the reactor or otherwise exposing the workpiece to the atmosphere between activation and carburization steps.

11. A process for surface hardening a workpiece made from an iron, nickel or chromium based alloy by gas carburization in which the workpiece is contacted with a carburizing gas at an elevated carburization temperature to cause carbon to diffuse into the workpiece surfaces thereby forming a hardened primary surface layer essentially free of carbide precipitates, wherein (1) the carburizing gas contains a carburizing specie comprising an unsaturated hydrocarbon, (2) the partial pressure of the carburizing specie in the carburizing gas is about 0.5 to 20 torr (~67 to ~2,666 Pa), (3) the total pressure of the carburizing gas is about 3.5 to 100 torr (~500 to ~13,000 Pa), (4) the carburizing gas also contains a companion gas, the companion gas comprising a gas that will react with oxygen under the above elevated carburization temperature and total pressure but which is not an unsaturated hydrocarbon, and (5) wherein the workpiece is activated by contact with an activating gas, activation and carburization being done in the same reactor without removing the workpiece from the reactor or otherwise exposing the workpiece to the atmosphere between activation and carburization steps, wherein the workpiece is activated at an activation pressure and an elevated activation temperature by contact with an activating gas mixture comprising a mixture of said activating gas and said companion gas, wherein the activation and carburization temperatures differ by no more than 100° C., and further wherein the activation and carburization pressures differ by no more than 20 torr.

12. The process of claim 11, wherein the activation and carburization temperatures differ by no more than 50° C., and further wherein the activation and carburization pressures differ by no more than 10 torr.

13. A process for surface hardening a workpiece made from an iron, nickel or chromium based alloy by gas carburization in which the workpiece is contacted with a carburizing gas at an elevated carburization temperature to cause carbon to diffuse into the workpiece surfaces thereby forming a hardened primary surface layer essentially free of carbide precipitates, wherein (1) the carburizing gas contains a carburizing specie comprising an unsaturated hydrocarbon, (2) the partial pressure of the carburizing specie in the carburizing gas is about 0.5 to 20 torr (~67 to ~2,666 Pa), (3) the total pressure of the carburizing gas is about 3.5 to 100 torr (~500 to ~13,000 Pa), (4) the carburizing gas also contains a companion gas, the companion gas comprising a gas that will react with oxygen under the above elevated carburization temperature and total pressure but which is not an unsaturated hydrocarbon, and (5) wherein the workpiece is activated by contact with an activating gas, activation and carburization being done in the same reactor without removing the workpiece from the reactor or otherwise exposing the workpiece to the atmosphere between activation and carburization steps, wherein the absolute pressure of the activating gas in the reactor during activation, and the absolute pressure of the carburizing gas in the reactor during carburization differ by no more than ±10%.

14. A process for surface hardening a stainless steel workpiece by gas carburization inside a carburization reactor in which the workpiece is contacted with a carburizing gas at an elevated carburization temperature to cause carbon to diffuse into the workpiece surfaces thereby forming a hardened primary surface layer essentially free of carbide precipitates, wherein (1) the carburizing gas contains a carburizing specie comprising an unsaturated hydrocarbon, (2) the partial pressure of the carburizing specie in the carburizing gas is about 0.5 to 20 torr (~67 to ~2,666 Pa), (3) the total pressure of the carburizing gas is about 3.5 to 100 torr (~500 to ~13,000 Pa), (4) the carburizing gas also contains a companion gas, the companion gas comprising a gas that will react with oxygen under the above elevated carburization temperature and total pressure but which is not an unsaturated hydrocarbon, and (5) wherein the workpiece is activated inside the carburization reactor by causing an activating gas comprising a mixture of 0.1 vol. % to 20 vol. % hydrogen chloride in hydrogen gas to flow into the reactor and contact the workpiece at 350° C. to 510° C. and 3.5 to 100 torr pressure for ¼ to 4 hours, after which the workpiece is carburized in a main carburization step without removing the workpiece from the carburizing reactor.

15. The process of claim 14, wherein an activating gas comprising a mixture of 0.5 vol. % to 10 vol. % hydrogen chloride in hydrogen gas is caused to flow into the reactor and contact the workpiece at 350° C. to 450° C. and 5 to 25 torr pressure, after which the workpiece is carburized in a main carburization step without removing the workpiece from the carburizing reactor by causing a carburization gas comprising 7% to 40% acetylene and the balance hydrogen to flow into the reactor and thereby contact the workpiece at a temperature of 350° C. to 450 C and a pressure of 5 to 25 torr.

16. The process of claim 15, wherein an activating gas comprising a mixture of 1 vol. % to 5 vol. % hydrogen chloride in hydrogen gas is caused to flow into the reactor and contact the workpiece at a pressure of 6 torr to 9 torr, after which the workpiece is carburized in a main carburization step without removing the workpiece from the carburizing reactor by causing a carburization gas comprising 10% to 35% acetylene and the balance hydrogen to flow into the reactor and thereby contact the workpiece at a pressure of 6 to 9 torr.

17. The process of claim 14, wherein the flow of activating gas to the reactor is interrupted, during this interruption the workpiece is subjected to a preliminary carburization step in which the workpiece is contacted with a carburizing gas comprising 10% to 35% acetylene and the balance hydrogen at a temperature of 350° C. to 450 C and a pressure of 6 to 9 torr for ¼ to 1 hour, after which activation of the workpiece is resumed.

18. The process of claim 17, wherein after activation of the workpiece is completed, the workpiece is carburized in a main carburization step in which the workpiece is contacted with a carburization gas whose acetylene content decreases from an initial value of about 20 vol. % to 35 vol. % to a final value of about 10 vol. %.

19. The process of claim 14, wherein the flowrate of at least one of (a) the hydrogen chloride content of the activation gas to the carburization reactor and (b) the acetylene content the carburizing gas to the carburization reactor is pulsed.

20. The process of claim 19, wherein the acetylene content of the carburizing gas to fed to the carburization reactor during the main carburization step is pulsed, and further wherein the carburization potential of the carburizing gas is decreased over the course of the main carburization step by decreasing the frequency of these pulses, decreasing the duration of these pulses, decreasing the concentration of the carburization specie in the carburization gas fed to the reactor during these pulses, or combinations thereof.

21. A process for surface hardening a workpiece made from an iron, nickel or chromium based alloy by gas carburization in which the workpiece is contacted with a carburizing gas at an elevated carburization temperature to cause carbon to diffuse into the workpiece surfaces thereby forming a hardened primary surface layer essentially free of carbide precipitates, wherein (1) the carburizing gas contains a carburizing specie comprising an unsaturated hydrocarbon, (2) the partial pressure of the carburizing specie in the carburizing gas is about 0.5 to 20 torr (~67 to ~2,666 Pa), (3) the total pressure of the carburizing gas is about 3.5 to 100 torr (~500 to ~13,000 Pa), (4) the carburizing gas also contains a companion gas, the companion gas comprising a gas that will react with oxygen under the above elevated carburization temperature and total pressure but which is not an unsaturated hydrocarbon, and (5) wherein the workpiece is activated by contact with an activating gas, activation and carburization being done in the same reactor without removing the workpiece from the reactor or otherwise exposing the workpiece to the atmosphere between activation and carburization steps, wherein the flow of activating gas to the reactor during the activating step is pulsed.

22. The process of claim 21, wherein the intensity of the activation treatment is reduced over the course of the activation treatment by decreasing the frequency of these pulses, decreasing the duration of these pulses, decreasing the concentration of the activating gas in the activating gas mixture fed to the reactor during these pulses, or combinations thereof.

23. A process for surface hardening a workpiece made from an iron, nickel or chromium based alloy by gas carburization in which the workpiece is contacted with a carburizing gas at an elevated carburization temperature to cause carbon to diffuse into the workpiece surfaces thereby forming a hardened primary surface layer essentially free of carbide precipitates, wherein (1) the carburizing gas contains a carburizing specie comprising an unsaturated hydrocarbon, (2) the partial pressure of the carburizing specie in the carburizing gas is about 0.5 to 20 torr (~67 to ~2,666 Pa), (3) the total pressure of the carburizing gas is about 3.5 to 100 torr (~500 to ~13,000 Pa), (4) the carburizing gas also contains a companion gas, the companion gas comprising hydrogen, natural gas, propane, another $C_1$-$C_6$ alkane or another saturated hydrocarbon, and (5) the carburization potential of the carburizing gas is changed over the course of the carburization reaction by at least one of (1) lowering the carburization temperature, (2) lowering the concentration of carburizing specie in the carburizing gas, (3) interrupting the carburization process while maintaining the workpiece at elevated temperature, and (4) interrupting the carburization process while maintaining the workpiece at elevated temperature and, in addition, reactivating the workpiece during this interruption by contact with a halogen containing gas.

24. The process of claim 23, wherein carburization is carried out in a carburization reactor, and further wherein the carburization potential is additionally changed by pulsing the flowrate of the carburizing specie fed to the carburization reactor.

25. A process for producing a surface-hardened, corrosion-resistant stainless steel workpiece exhibiting a shiny metallic appearance without requiring removal of byproduct soot or thermal oxide from the workpiece surfaces, the process comprising contacting the workpiece surfaces with a carburizing gas in a carburizing reactor under conditions of time and temperature which are sufficient to cause carbon to diffuse into the workpiece surfaces thereby forming a hardened primary surface layer essentially free of carbide precipitates, wherein (1) the carburizing gas fed to the reactor comprises acetylene and hydrogen, (2) the partial pressure of acetylene in the carburizing gas is about 0.5 to 20 torr (~67 to ~2,666 Pa), and (3) the total pressure of the carburizing gas is about 3.5 to 100 torr (~500 to ~13,000 Pa).

26. The process of claim 25, wherein the carburization potential of the carburizing gas is changed over the course of the carburization reaction by at least one of (1) lowering the carburization temperature, (2) lowering the concentration of carburizing specie in the carburizing gas, (3) interrupting the carburization process while maintaining the workpiece at elevated temperature, and (4) interrupting the carburization process while maintaining the workpiece at elevated temperature and, in addition, reactivating the workpiece during this interruption by contact with a halogen containing gas.

27. The process of claim 25, wherein the molar ratio of hydrogen to acetylene in the carburizing gas is at least 2:1.

28. The process of claim 27, wherein prior to contact of the workpiece with the carburizing gas, the workpiece is contacted with an activating gas comprising a mixture of hydrogen and a halogen containing gas.

29. The process of claim 28, wherein the workpiece is contacted with the activating gas and the carburizing gas in the same carburization reactor without exposing the workpiece to contact with the atmosphere between contact with the activating gas and the carburizing gas.

30. The process of claim 29, wherein the flowrate to the carburization reactor of at least one of (a) the activating gas and (b) the acetylene in the carburizing gas is pulsed.

31. The process of claim 30, wherein the acetylene content of the carburizing gas to the carburization reactor is pulsed.

32. The process of claim 31, wherein at least one of the duration of the pulse and the frequency of the pulse is shortened from an higher value at in early stages of carburization to a relatively lower value in later stages of carburization so that the carburization potential of the carburization gas decreases over the course of the carburization reaction.

* * * * *